US007797919B2

(12) United States Patent
Kirth et al.

(10) Patent No.: US 7,797,919 B2
(45) Date of Patent: Sep. 21, 2010

(54) STRAND WITH INCREASED ADHERENCE TO METAL DISKS

(75) Inventors: Rudolf Kirth, Vöcklabruck (AT); Klaus Kronlachner, Krenglbach (AT); Susanna Schiemer, Linz (AT); Georg Sonnleitner, Buchkirchen (AT)

(73) Assignee: Teufelberger Gesellschaft m.b.H. (AT)

( * ) Notice: Subject to any disclaimer, the term of this patent is extended or adjusted under 35 U.S.C. 154(b) by 309 days.

(21) Appl. No.: 11/720,186

(22) PCT Filed: Nov. 23, 2005

(86) PCT No.: PCT/AT2005/000469

§ 371 (c)(1),
(2), (4) Date: Jan. 31, 2008

(87) PCT Pub. No.: WO2006/055995

PCT Pub. Date: Jun. 1, 2006

(65) Prior Publication Data

US 2008/0127625 A1 Jun. 5, 2008

(30) Foreign Application Priority Data

Nov. 25, 2004 (AT) ..... A 1991/2004

(51) Int. Cl.
*D02G 3/02* (2006.01)

(52) U.S. Cl. ..... 57/210; 57/227; 57/232; 87/1; 87/8

(58) Field of Classification Search ..... 57/210, 57/226, 227, 232, 246; 87/1, 8
See application file for complete search history.

(56) References Cited

U.S. PATENT DOCUMENTS

| | | | | |
|---|---|---|---|---|
| 4,016,714 | A | 4/1977 | Crandall et al. | |
| 4,563,869 | A | 1/1986 | Stanton | |
| 5,934,168 | A * | 8/1999 | Feichtinger et al. | 87/8 |
| 2003/0005681 | A1 * | 1/2003 | He et al. | 57/210 |
| 2004/0002272 | A1 * | 1/2004 | Land | 442/190 |
| 2004/0068972 | A1 * | 4/2004 | Kanno et al. | 57/210 |

FOREIGN PATENT DOCUMENTS

| | | |
|---|---|---|
| DE | 2 222 312 | 11/1973 |
| EP | 0150702 | 11/1984 |
| EP | 0 150 702 A | 8/1985 |
| EP | 0 198 567 A | 10/1986 |

* cited by examiner

*Primary Examiner*—Shaun R Hurley
(74) *Attorney, Agent, or Firm*—Lowe Hauptman Ham & Berner, LLP

(57) ABSTRACT

The invention concerns a rope or a rope element which comprises, in a manner known per se, a reinforcement made of a fiber material varying from the fiber material of the rope or the rope element, respectively. The rope or the rope element, respectively, according to the invention wherein at least one multifilament yarn and/or staple fiber yarn and/or at least one monofilament is/are at least partially provided as the fiber material of the reinforcement.

34 Claims, 4 Drawing Sheets

STRAND WITH INCREASED ADHERENCE TO METAL DISKS

CROSS-REFERENCE TO RELATED APPLICATIONS

Figure 1:
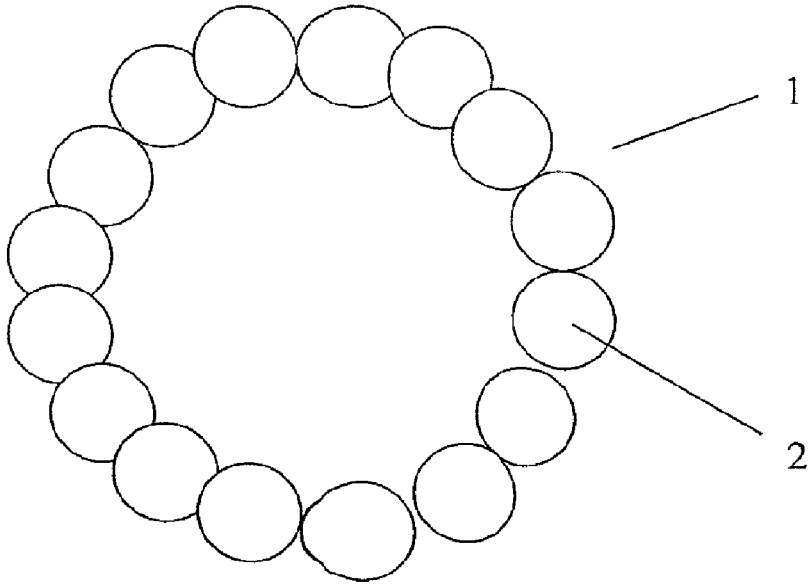

The present Application is based on International Application No. PCT/AT2005/000469, filed on Nov. 23, 2005, which in turn corresponds to Austria Application No. A 1991/2004 filed on Nov. 25, 2004, and priority is hereby claimed under 35 USC §119 based on these applications. Each of these applications are hereby incorporated by reference in their entirety into the present application.

The present invention concerns a rope or a rope element, respectively, which is used for the production of a rope.

From EP 0 150 702 B2, a rope is known which as such has or the rope elements of which, respectively, have a so-called "reinforcement" made of a fibre material which varies from the fibre material of the rope or the rope elements, respectively.

By means of the reinforcement as described in EP 0 150 702 B2, it is possible to achieve a substantially increased lifetime or breaking strength, respectively, of the rope under alternating bending stress as well as in case of a diversion around narrow radii and sharp edges, respectively.

For the purposes of the present invention, by "reinforcement" is understood the fact that something is wrapped, braided, knitted etc. around the fibre material of the rope or the rope element, respectively, wherein, however, the surface of the fibre material of the rope or the rope element, respectively, is not covered completely.

Therefore, a reinforcement in the context of the present invention has to be distinguished from a complete coating of a rope or a rope element, respectively, wherein the entire surface is covered by a different material.

From DE 2 222 312, it is known to incorporate monofilaments with different elongations at break in the rope or to coat the rope therewith, respectively, in order to reduce the energy created when highly stressed ropes rebound in case of rupture.

In U.S. Pat. No. 4,563,869, it is likewise suggested that yarns of different elongation properties be used.

It has been shown that ropes, according to the teaching of EP 0 150 702, in particular when being used in the form of industrial ropes, e.g., as a paper guide rope, indeed have an increased lifetime, but exhibit insufficient static friction properties when they are guided over smooth surfaces especially at the onset of their use. The rope slips through and cannot be driven along at all or only to an inadequate extent.

This situation improves only after extended use of said ropes, as portions of the relatively hard reinforcement tear open, forming a "brush" by means of which the drive is successfully achieved. On the other hand, however, this is associated with the disadvantage that fragments of the reinforcement lead to dust formation and the soiling of machine parts which get into contact with the rope.

It is the object of the present invention to overcome the aforementioned disadvantages of the prior art and, in particular, to provide a rope which, in addition, has improved static friction properties while exhibiting at least a consistently long lifetime and high load-bearing capacity.

Said object is achieved by means of a rope or a rope element, respectively, which comprises, in a manner known per se, a reinforcement made of a fibre material varying from the fibre material of the rope or the rope element, respectively, characterized in that a) at least one multifilament yarn and/or staple fibre yarn and/or b) at least one monofilament is/are at least partially provided as the fibre material of the reinforcement.

In the context of the present invention, a "rope element" is understood to be any subunit of a rope, e.g., a strand or a twine used as a fibre material, which, together with other subunits, forms a rope or larger subunits of a rope.

When, in the following, a rope element is furthermore mentioned, these embodiments always also refer to a form of the present invention in which an entire rope as such is provided with a reinforcement.

A "varying" fibre material is understood to be a fibre material which differs from the fibre material of the rope or the rope element, respectively, e.g., in terms of its chemical nature (e.g., a different base polymer) or in terms of textile properties such as titre, texture, twist (for example, in twines), etc.

If a material a) and/or b) is used as an at least partial component of the reinforcement of a rope element or a rope, respectively, the static friction and abrasion properties of the rope can be enhanced in an excellent manner without having a negative impact on lifetime and load-bearing capacity. Rather, ropes according to the invention can have an even longer lifetime than ropes known from the prior art.

The material a) is preferably a multifilament yarn and/or a staple fibre yarn from the group consisting of polyacrylate, polyamide, aramide, preferably p-aramide, HM-polyethylene, polybenzoxazol and mixtures thereof.

These materials exhibit a comparatively low hardness, i.e., a better formability under transverse pressure, and thus a higher static friction, which, in the following, is paraphrased by the term "higher grip." Rather than monofilaments, they are threads, yarns and twines made of multifilaments or staple fibres, respectively. Staple fibre yarns especially have a grip-increasing effect. At the same time, the improved formability under transverse pressure leads to a longer lifetime under the rubbing stress which is typical of industrial ropes.

Particularly preferably, the multifilament yarn of material a) is textured.

With particular preference, at least one polyacrylate staple fibre yarn and/or one polyamide BCF multifilament yarn is/are provided as the material a).

The staple fibre yarn or, respectively, the multifilament yarn of material a) can preferably be used in a titre range of from 500 dtex to 4500 dtex.

In a further preferred embodiment, the material a) and/or the material b) is/are present at least partly in an impregnated form.

An adequate impregnation also increases the grip of the materials employed, which is beneficial in particular in case of material b).

Preferably, at least one monofilament from the group consisting of polyamide, polypropylene, polyethylene, polyester and mixtures thereof, which optionally has been impregnated, is used as the material b).

All non-impregnated monofilaments which have improved static friction properties in comparison to monofilaments traditionally used as reinforcement materials are likewise suitable as material b).

Monofilaments with an elongation at break of at least 27% are particularly suitable as material b). The use of monofilaments having a higher elongation at break (and hence a lower hardness and a better formability under transverse pressure, respectively) increases the lifetime of the rope.

As a result of a surface impregnation of material a) or of material b), respectively, the static friction value can be increased and the abrasion resistance and hence the lifetime can be improved. Common textile impregnation agents such as fatty acid esters, waxes, silicones, fluorocarbons and polyurethanes or mixtures thereof can be used for impregnation.

In the context of the present invention, not only the reinforcement material as such but also at least a portion of the rope elements or the rope as such, respectively, or the fibre material of the rope or of the rope elements, respectively, can be present in an impregnated form.

A particularly preferred embodiment of the present invention consists in that a combination of the material a) and/or the material b) as well as a material c) in the form of at least one non-impregnated monofilament, which i) is non-impregnated and/or ii) has an elongation at break of less than 27%, is provided as the reinforcement.

Preferably, at least one monofilament from the group consisting of polyamide, polypropylene, polyethylene, polyester and mixtures thereof is thereby provided as the material c).

By a combination of material a) and/or b) with material c) is meant in particular that a rope element, e.g., a twine, is reinforced by a certain number of threads of material a) and/or b) and, additionally, by a certain number of threads of material c), i.e., said threads being, for example, braided or knitted around said rope element.

The ratio of the sum of the portions of materials a) and b) to the portions of material c) in the combination thereby ranges from 3:1 to 1:7, preferably from 1:1 to 1:4.

Thereby, the ratio is understood to be the numerical ratio between the number of threads of material a) or b), respectively, and the threads of material c).

This is to be explained based on a twine which is provided, in a manner known per se, with a reinforcement in the form of a surrounding braiding consisting of 16 threads. 4 threads are thereby supposed to be formed from a staple fibre yarn according to the specification of material a), the remaining 12 threads are supposed to be formed from a non-impregnated monofilament according to the specification of material c). In said case, the ratio of the portions of material a) to the portions of material c) is 4:12, i.e., 1:3.

The fibre material of the reinforcement is preferably wrapped, braided, knitted, crocheted, woven and/or worked around the rope or the rope element, respectively. The type of the attachment of the reinforcement can thereby also affect the grip of the rope element or the rope, respectively.

Particularly preferred is an embodiment wherein the fibre material of the reinforcement is braided around at least a portion of the rope elements of the rope and the fibre material of the reinforcement is knitted around a further portion of the rope elements.

Furthermore, an embodiment of a rope is preferred wherein threads of material a) are knitted around a part of the strands and threads of material c) are braided around another part of the strands.

In further embodiments, threads of materials a) and b) can be knitted around a part of the strands and threads of material c) can be braided around another part of the strands or threads of materials a), b) and c) can be knitted around a part of the strands and threads of materials a), b) and c) can be braided around another part of the strands.

The grip of the rope or the rope element, respectively, can be influenced not only by the type of the reinforcement but also by the choice of the fibre material for the rope element.

A further preferred embodiment of the present invention is thus characterized in that multifilament yarns from polyamide and/or polyester multifilaments, which optionally have been impregnated, are provided as the fibre material of the rope element.

A polyamide yarn PA 6 having a titre of 8800 dtex (a twine of 80 T/m) can, for example, be used as a fibre material for the construction of a strand of the rope according to the invention.

Particularly preferably, textured multifilament yarns and/or staple fibre yarns are admixed to said multifilament yarns. The texture of the multifilament yarns or, respectively, hairs of the staple fibre yarns which project beyond the reinforcement cause a further increase in the grip.

A preferred embodiment of the rope element according to the invention is a twine which is reinforced by threads of material a) and/or b) or optionally also by threads of material c).

Two or more twines reinforced in this manner can be combined to form a strand.

However, a rope element according to the invention in the form of a strand composed of two or more twines, which optionally are reinforced, can also be reinforced as such, i.e., a reinforcement material as provided according to the invention is braided or knitted etc. around the strand consisting of several twines.

In a manner known per se, the twines forming a strand can be present in a state in which they are arranged in parallel, twined, twisted and/or braided.

Furthermore, the present invention concerns a rope, in particular an industrial rope, which contains at least one rope element reinforced according to the invention.

The rope according to the invention can be designed such that it comprises, in addition to one or several rope element(s) reinforced according to the invention, further rope elements which have no reinforcement. For example, a part of the strands forming the rope can be reinforced by material a) and/or b), whereas further strands are unreinforced.

Furthermore, an embodiment is preferred wherein the rope, apart from rope elements (e.g. strands) reinforced by material a) and/or b), also comprises rope elements reinforced exclusively by material c). Also in this embodiment, the rope can have additional rope elements which are not reinforced at all.

As already mentioned initially, the rope according to the invention can also itself be provided with a reinforcement made of material a) and/or b) and optionally material c), which is attached to the finished rope.

The ropes according to the invention can be braided or twisted or beaten, respectively, in a manner known per se. They can be hollow ropes or core ropes.

In comparison to ropes known per se, in particular paper guide ropes known per se, the ropes according to the invention are characterized by an increased static friction. The coefficient of static friction determined according to the measuring method as described further below is preferably more than 1.20, preferably more than 1.25, particularly preferably more than 1.30.

Accordingly, ropes according to the invention are particularly suitable as industrial ropes, especially as paper guide ropes.

Below, the invention is described in further detail based on the figures and exemplary embodiments:

SHORT DESCRIPTION OF THE FIGURES

FIG. 1 schematically shows a section through an embodiment of the rope according to the invention.

Figure 2:
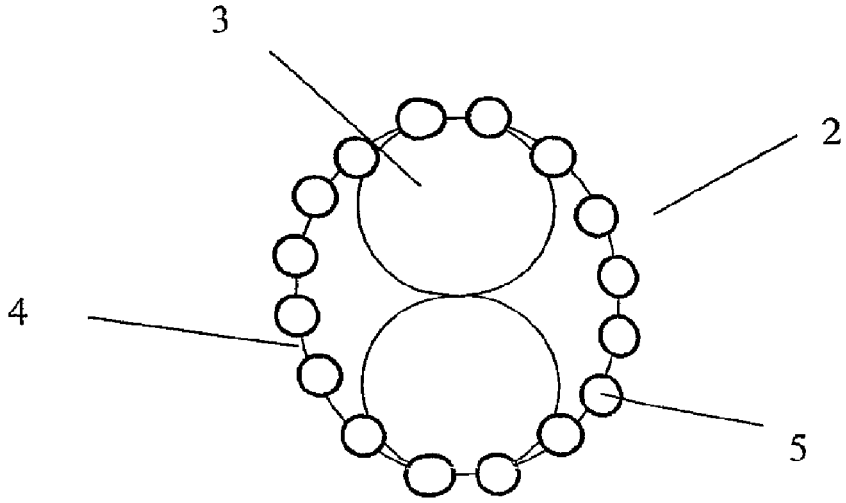

FIG. 2 schematically shows a section through a strand reinforced according to the invention.

Figure 3:
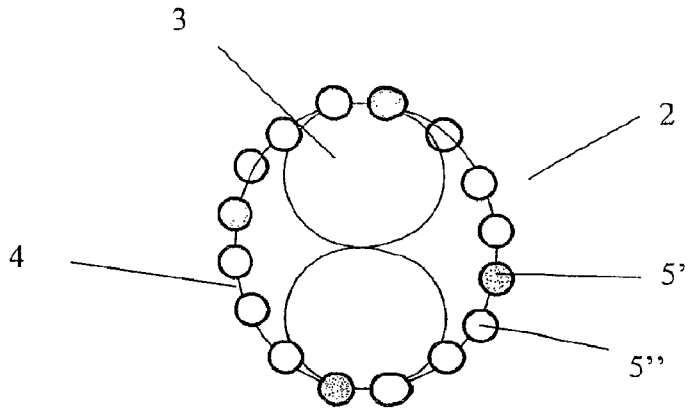

FIG. 3 schematically shows a section through a further embodiment of a strand reinforced according to the invention.

Figure 4:
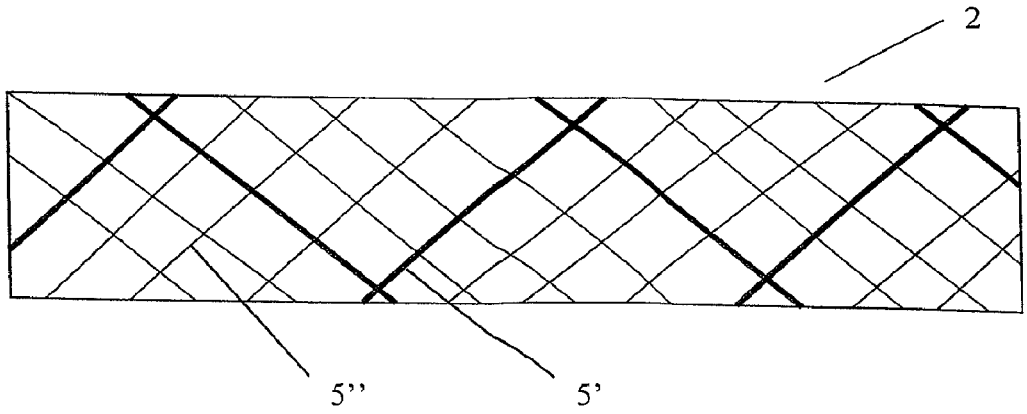

FIG. 4 schematically shows a longitudinal section of the strand according to FIG. 3.

Figure 5:
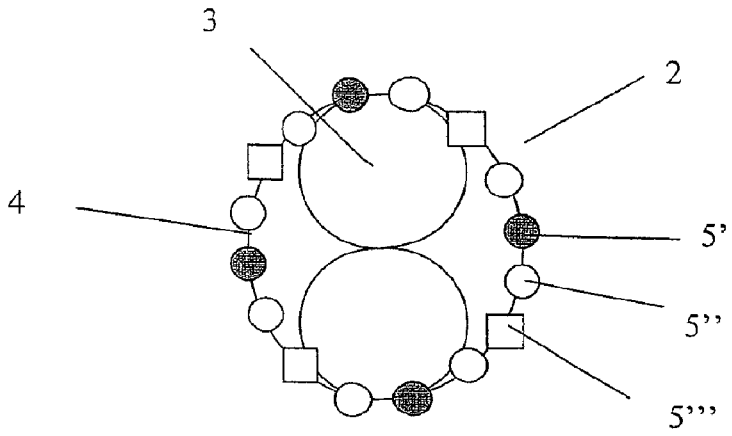
Figure 6:
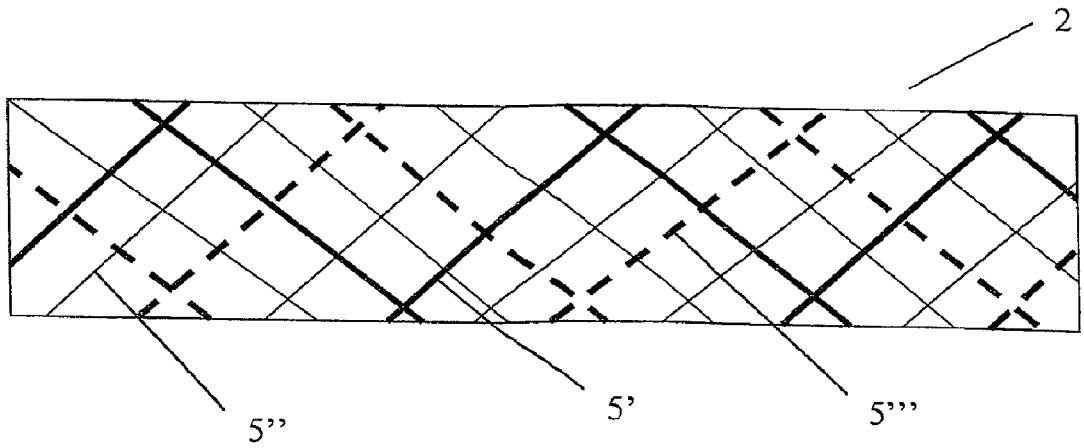

FIGS. 5 and 6 schematically show a section (FIG. 5) and a longitudinal section (FIG. 6), respectively, through a further embodiment of a strand reinforced according to the invention.

Figure 7:
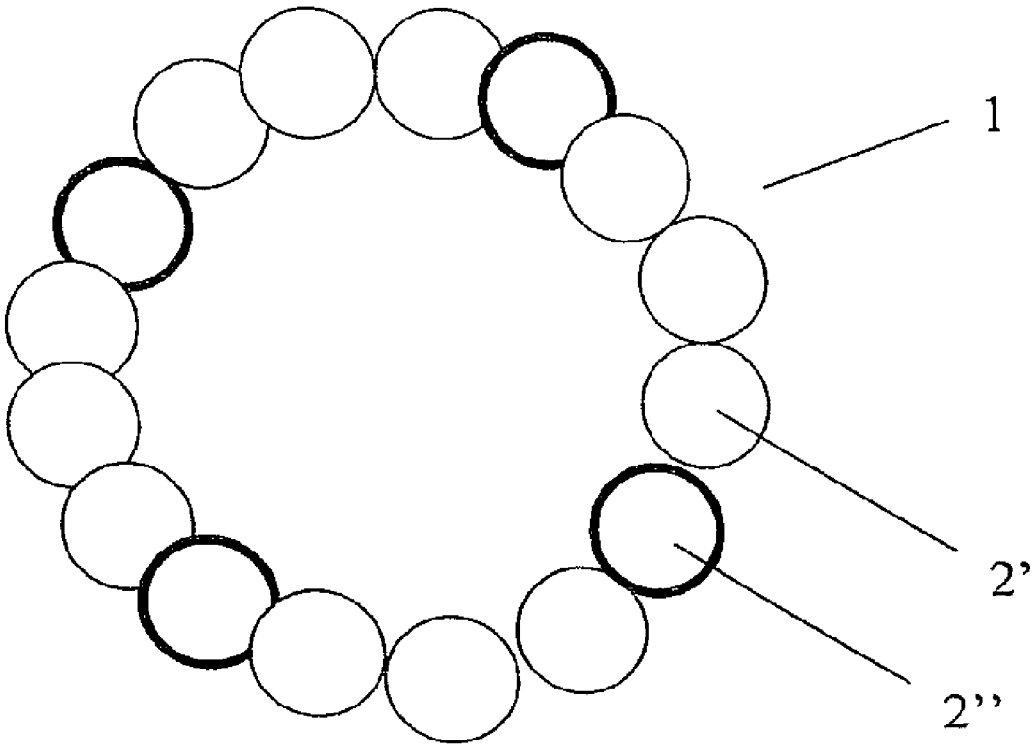

FIG. 7 schematically shows a section through a further embodiment of the rope according to the invention.

An embodiment of a braided rope 1 according to the invention as per FIG. 1 essentially consists of strands 2.

In the embodiment according to FIG. 2, a strand 2 is composed of two twines 3 which, for example, can be arranged in parallel or in a state of being twisted with each other. A reinforcement 4 is braided around the strand 2, which reinforcement, in the example as per FIG. 2, is composed of 16 impregnated polyamide monofilaments 5 having an elongation at break of 26%.

In the embodiment according to FIGS. 3 and 4, a reinforcement 4 is braided around the strand 2, which reinforcement is, in turn, composed of 16 threads, with 4 threads 5' consisting of a PAC staple fibre yarn (i.e., a material a)) and the remaining 12 threads 5" consisting of a non-impregnated polyamide monofilament having an elongation at break of 26% (i.e., a material c)).

The reinforcement pattern resulting therefrom is evident from the longitudinal section according to FIG. 4.

In a further embodiment, which has not been illustrated, the 12 threads made up of the above described polyamide monofilament can also be present in an impregnated form (material b)).

In the embodiment according to FIGS. 5 and 6, four yarn threads 5' made of a PAC staple fibre yarn (material a)), 8 yarn threads 5" made of a non-impregnated polyamide monofilament having an elongation at break of 26% (material c)) and 4 yarn threads 5'" made of a polyamide BCF yarn (a further material a)) are provided as the reinforcement 4. The reinforcement pattern resulting therefrom is evident from the longitudinal section according to FIG. 6.

The embodiment of the rope according to the invention as per FIG. 7 comprises two different types of strands 2' and 2". Non-impregnated polyamide monofilaments having an elongation at break of 26% (material c)) are braided around strand 2', whereas a PAC staple fibre yarn (material a)) is knitted around strand 2".

EXAMPLES

Ropes having the basic design as shown in FIG. 1 were produced, with a PA6 multifilament yarn of 8800 dtex (a twine of 80 T/m) being employed in each case as the fibre material for the twines used for constructing the strands.

The strands were reinforced by various fibre materials and a rope was produced from the reinforced strands in a manner known per se.

In order to determine the static friction properties of the rope, the rope was pulled in the circumferential direction across a stationary metal drum made of steel ST 60, according to the test standard ASTM D 3108-01. The metal drum is mounted in a non-twistable manner and provided with a torque sensor. As a result of the rope's adhesion, a torque, which is a measure of the static friction value, is generated when the rope exerts traction on the metal drum.

For performing a measurement, a test sample having a length of about 2 m is used. One end of the rope is loaded with a stretching weight of 5 kg, the rope is guided at an angle of wrap of approx. 90° across the metal drum comprising the torque sensor and a subsequent guide roll and is clamped at the other end into a drive pulley. By means of the drive pulley, a traction is exerted on the rope so that the drive pulley rotates by 90° together with the rope, beginning at the starting point, and the force thereby acting on the metal drum is measured. The result is a coefficient of static friction which can be used for a relative comparison of test samples.

In the following table, the measured values achieved with ropes whose strands were reinforced by different materials are listed:

TABLE

| Example | Reinforcement material | Coefficient of static friction |
|---|---|---|
| 1 | 12 polyamide monofilaments, non-impregnated, elongation at break 26%<br>4 yarn threads made of PAC staple fibre yarn 560 dtex (FIGS. 3 and 4) | 1.51 |
| 2 | 16 polyamide monofilaments, elongation at break 26%, impregnated (FIG. 2) | 1.32 |
| 3 | 12 polyamide monofilaments, elongation at break 26%, impregnated<br>4 yarn threads made of PAC staple fibre yarn 560 dtex<br>(FIGS. 3 and 4) | 1.44 |
| 4 | 8 polyamide monofilaments, elongation at break 26%, non-impregnated,<br>4 yarn threads made of PAC staple fibre yarn 560 dtex<br>4 threads made of polyamide BCF multifilament yarn 800 dtex<br>(FIGS. 5 and 6) | 1.45 |
| 5 | PAC staple fibre yarn, 560 dtex, knitted around 4 strands of the rope,<br>16 polyamide monofilaments, elongation at break 26%, non-impregnated, braided around the remaining strands | 1.31 |
| 6 (comparison) | 16 polyamide monofilaments, elongation at break 26%, non-impregnated | 1.19 |

The table shows a clear improvement in the static friction of the rope compared to a rope with a conventional reinforcement (experiment 6).

The invention claimed is:

1. A rope or a rope element which comprises:

a reinforcement covering less than an entire surface of a fiber material of the rope or rope element, wherein said reinforcement is made of a fiber material varying from the fiber material of the rope or the rope element, respectively, wherein the fiber material of the reinforcement further comprises, a first material selected from the group consisting of at least one multifilament yarn and/or staple fiber yarn; and a second material selected from the group consisting of at least one monofilament.

2. A rope or a rope element according to claim 1, wherein at least one multifilament yarn or staple fiber yarn from the group consisting of polyacrylate, polyamide, aramide, HM-polyethylene, polybenzoxazol and mixtures thereof is provided as said first material.

3. A rope or a rope element according to claim 1, wherein the multifilament yarn of said first material is textured.

4. A rope or a rope element according to claim 2, wherein at least one polyacrylate staple fiber yarn or one polyamide BCF multifilament yarn is provided as said first material.

5. A rope or a rope element according to claim 1, wherein said first material or said second material is present at least partly in an impregnated form.

6. A rope or a rope element according to claim 1, wherein at least one monofilament from the group consisting of polyamide, polypropylene, polyethylene, polyester and mixtures thereof, is provided as said second material.

7. A rope or a rope element according to claim 6, wherein the monofilament of said second material has an elongation at break of at least 27%.

8. A rope or a rope element according to claim 5, wherein said first material, or said second material, respectively, is impregnated with an impregnation material selected from the group consisting of fatty acid esters, waxes, silicones, fluorocarbons and polyurethanes or mixtures thereof, which material increases the static friction.

9. A rope or a rope element according to any of the preceding claims, wherein a combination of said first material as well as a third material in the form of at least one monofilament, which is non-impregnated or has an elongation at break of less than 27%, is provided as the reinforcement.

10. A rope or a rope element according to claim 9, wherein at least one monofilament from the group consisting of polyamide, polypropylene, polyethylene, polyester and mixtures thereof is provided as said third material.

11. A rope or a rope element according to claim 9, wherein the ratio of the sum of the portions of said first and second materials to the portions of said third material in the combination ranges from 3:1 to 1:7.

12. A rope or a rope element according to claim 1, wherein the fiber material of the reinforcement is braided around at least a portion of the rope elements and the fiber material of the reinforcement is knitted around a further portion of the rope elements.

13. A rope or a rope element according to claim 1, wherein multifilament yarns from polyamide or polyester multifilaments, are provided as the fiber material of the rope or the rope elements.

14. A rope or a rope element according to claim 13, wherein textured multifilament yarns or staple fiber yarns are admixed to the multifilament yarns.

15. A rope element in the form of a strand of a rope, which strand is composed of two or more twines, wherein the strand as a whole has a reinforcement according to claim 1.

16. A rope element according to claim 15, wherein the twines are present in a state in which they are arranged in parallel, twined, twisted or braided.

17. A rope, comprising at least one rope element according to claim 1.

18. A rope according to claim 17, comprising at least one further rope element which has no reinforcement.

19. A rope according to claim 17, comprising at least one further rope element which has a reinforcement consisting exclusively of a third material in the form of at least one monofilament, which is non-impregnated; or has an elongation at break of less than 27%.

20. The use of a rope according to claim 1 as an industrial rope.

21. A rope or a rope element according to claim 1, wherein at least one multifilament yarn and staple fiber yarn from the group consisting of polyacrylate, polyamide, aramide, HM-polyethylene, polybenzoxazol and mixtures thereof is provided as said first material.

22. A rope or a rope element according to claim 1, wherein said first material and said second material is present at least partly in an impregnated form.

23. A rope or a rope element according to claim 1, wherein multifilament yarns from polyamide and polyester multifilaments, are provided as the fiber material of the rope or the rope elements.

24. A rope or a rope element according to claim 23, wherein textured multifilament yarns or staple fiber yarns are admixed to the multifilament yarns.

25. A rope or a rope element according to claim 2, wherein at least one polyacrylate staple fiber yarn and one polyamide BCF multifilament yarn is provided as said first material.

26. A rope or a rope element according to claim 6, wherein said monofilament has been impregnated.

27. A rope or a rope element according to any one of claims 1-8, wherein a combination of said first material as well as a third material in the form of at least one monofilament, which is non-impregnated and has an elongation at break of less than 27%, is provided as the reinforcement.

28. A rope or a rope element according to claim 11, wherein said ratio ranges form 1:1 to 1:4.

29. A rope or a rope element according to claim 13, wherein said multifilament yarns have been impregnated.

30. A rope element according to claim 16, wherein the twines are present in a state in which they are arranged in parallel, twined, twisted and braided.

31. A rope element according to claim 15, wherein said twines are each reinforced.

32. A rope according to claim 17 being present as an industrial rope.

33. A rope according to claim 17, comprising at least one further rope element which has a reinforcement consisting exclusively of a third material in the form of at least one monofilament, which is non-impregnated; and has an elongation at break of less than 27%.

34. The use according to claim 20, wherein said rope is used as a paper guide rope.

* * * * *